United States Patent [19]

Siegmund

[11] 4,207,273

[45] Jun. 10, 1980

[54] THROTTLE LINKAGE

[75] Inventor: Gustav J. Siegmund, Southfield, Mich.

[73] Assignee: Ford Motor Company, Dearborn, Mich.

[21] Appl. No.: 969,502

[22] Filed: Dec. 14, 1978

[51] Int. Cl.[2] ..... F02M 13/04

[52] U.S. Cl. ..... 261/23 A; 261/41 C

[58] Field of Search ..... 261/41 C, 23 A

[56] References Cited

U.S. PATENT DOCUMENTS

| | | | |
|---|---|---|---|
| 1,931,599 | 10/1933 | Aseltine | 261/41 C |
| 3,003,488 | 10/1961 | Carlson | 261/41 C |
| 3,030,819 | 4/1962 | Edelbrock, Jr. | 261/41 C |
| 3,228,007 | 6/1967 | Bickhaus et al. | 261/41 C |
| 3,259,376 | 7/1966 | Baer | 261/41 C |
| 3,272,483 | 9/1966 | Martin | 261/41 C |
| 3,328,008 | 6/1967 | Gordon | 261/41 C |
| 3,575,385 | 4/1971 | Szwargulski et al. | 261/41 C |
| 3,764,119 | 10/1973 | Niebrzydoski | 261/41 C |
| 3,796,413 | 3/1974 | Woods | 261/41 C |

*Primary Examiner*—Tim R. Miles

*Attorney, Agent, or Firm*—Steven L. Permut; Keith L. Zerschling

[57] ABSTRACT

A carburetor having a primary and secondary induction passages with a primary and secondary throttle valve pivotably mounted respectively in these passages with a mechanical linkage between the primary and secondary throttle valve for opening the secondary throttle valve. A spring is mounted normally to close the secondary throttle valve when the primary throttle valve is moved to a closed position with the mechanical linkage constructed to close the secondary throttle valve when the primary throttle valve is moved toward a closed position when the spring refrains from closing the secondary throttle valve.

8 Claims, 7 Drawing Figures

THROTTLE LINKAGE

BACKGROUND OF THE INVENTION

1. Field of the Invention

This invention relates to a throttle for a two-stage carburetor and more particularly it relates to a mechanism for opening and closing secondary throttle valves of a multi-stage carburetor.

2. Description of the Prior Art

Multi-stage carburetors have primary and secondary induction passages with each primary and secondary passage opened and closed by a throttle valve. The primary and secondary throttle valves are operably linked together such that the secondary throttle valve is opened by the opening of the primary throttle valve only after the primary throttle valve has been substantially open. This operation may be accomplished by a delayed camming system. One such delayed camming system is disclosed in U.S. Pat. No. 3,259,376 issued to Baer on July 5, 1966.

Many of the throttle linkage systems disclosed in the prior art not only open the secondary throttle valve but also mechanically close the secondary throttle valve. One such linkage is disclosed in U.S. Pat. No. 3,328,008 issued to Gordon on June 27, 1967. The Gordon patent discloses a linkage which has a cam which abuts a lug on a secondary throttle lever valve which slightly opens the secondary throttle plate. A rod attaching the primary throttle to the secondary throttle further opens the secondary throttle upon further opening of the primary throttle. Upon closure of the primary throttle, the cam abuts an extension on the secondary throttle to close the secondary throttle.

U.S. Pat. No. 3,796,413 issued to Woods on March 12, 1974 and U.S. Pat. No. 3,328,007 issued to Bickhaus et al on June 27, 1967 disclose a mechanical linkage including a rod connected to the primary and secondary throttle with a slot in the secondary throttle lever to provide lost motion of the rod as it follows a primary throttle when it opens or closes. In such mechanical linkages, the primary throttle is free to move to a partially opened position before the secondary throttle is forced open.

U.S. Pat. No. 3,764,119 issued to Niebrzydoski on Oct. 9, 1973 and U.S. Pat. No. 3,575,385 issued to Szwargulski et al on Apr. 20, 1971 disclose a secondary throttle which is spring biased to the closed position. The secondary throttle has a backup closure mechanism generally comprising a complementary ear and tab coaxially mounted about the primary throttle pivot axis which are operably connected to a lever connected to the secondary throttle. The tab engages the ear which causes the lever to move the secondary throttle to the closed position after the primary throttle is substantially closed.

SUMMARY OF THE DISCLOSURE

According to the disclosure, a multi-stage carburetor has a primary and secondary induction passage with a primary throttle plate pivotably mounted in the primary induction passage for movement between open and closed positions, a secondary throttle plate pivotably mounted in the secondary induction passage for movement between an open and close position, and a linkage between the primary and secondary throttles such that opening or closing movement of the primary throttle causes a respective opening or closing movement of the secondary throttle. The first throttle has an opening and closing mechanism connected thereto.

Further according to the disclosure, the linkage links the primary throttle to the secondary throttle such that the primary throttle moves to a partially open position with no effect on the secondary throttle and movement of the primary throttle toward a fully opened position beyond the partially open position causes the linkage to open the secondary throttle.

In one embodiment, the mechanical linkage has primary and secondary throttles pivotably mounted about substantially parallel first and second axes. The primary and secondary throttles have first and second levers attached thereto having coplaner flange sections which are substantially perpendicular from the pivot axes of the throttles. A slot is defined within each flange section. A rod has two ends pivotably slideably attached to the respective slots.

In one embodiment, each slot has its respective longitudinal axis comprising a radial and tangential component with respect to the pivotal axis of said respective throttle valve. The distance from one slot to the longitudinal axis of the other slot when the throttles are in their respective closed positions is relatively small compared to the distance from said one slot to said longitudinal axis of said other slot when the throttles are in their respective open positions. The longitudinal axis of the rod forms acute angles with the longitudinal axes of the first and second slots when the throttles are in their respective closed positions but is substantially transverse to the longitudinal axes of the slots when the throttles are in their respective open positions.

Further according to the disclosure, the linkage rod is constructed and connected to the primary and secondary throttles to gradually close the secondary throttle when the first throttle valve is moved toward the closed position only if the principal closing mechanism refrains from closing the second throttle valve.

The linkage rod mounted in slots of the primary and secondary throttle levers provide a lost motion mechanism which allows the principal closing means to act. The linkage rod mechanically closes the second throttle valve after a slight closure movement of the primary throttle if the principal closing mechanism refrains from operating. In one embodiment, the primary throttle is free to move 5% to 25% from a fully open position toward its closed position such that the rod has both ends riding from one end of each first and second slots to another end of each first and second slots while said secondary throttle remains in its open position if the principal closing mechanism refrains to close the second throttle and said rod gradually closing said secondary throttle upon further closure of the primary throttle.

BRIEF DESCRIPTION OF THE DRAWINGS

The invention will now be described with reference to the accompanying drawings in which.

DETAILED DESCRIPTION OF THE PRESENTLY PREFERRED EMBODIMENT

Figure 1:
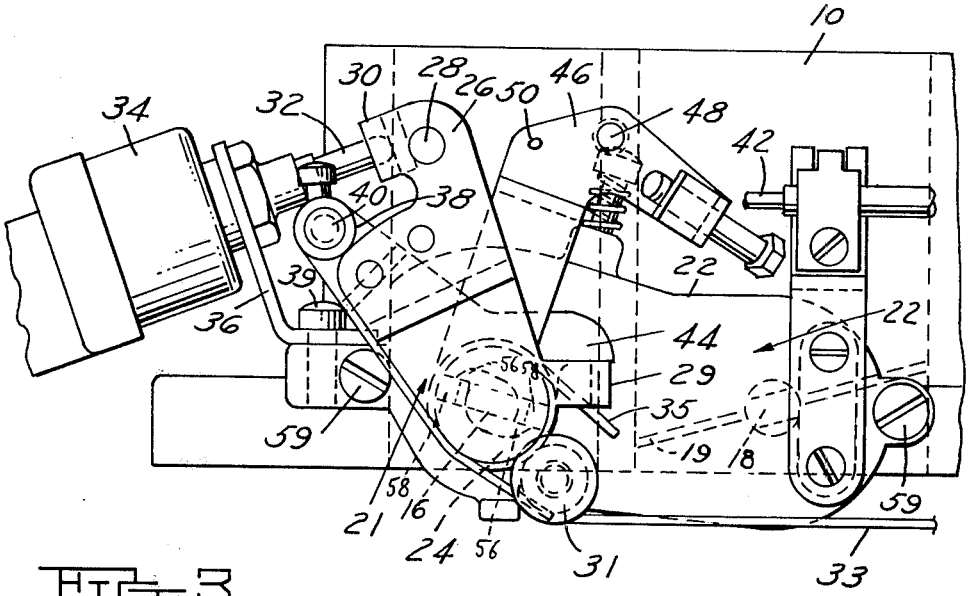
FIG. 1 is a side elevational view of the preferred embodiment of the invention.
Figure 2:
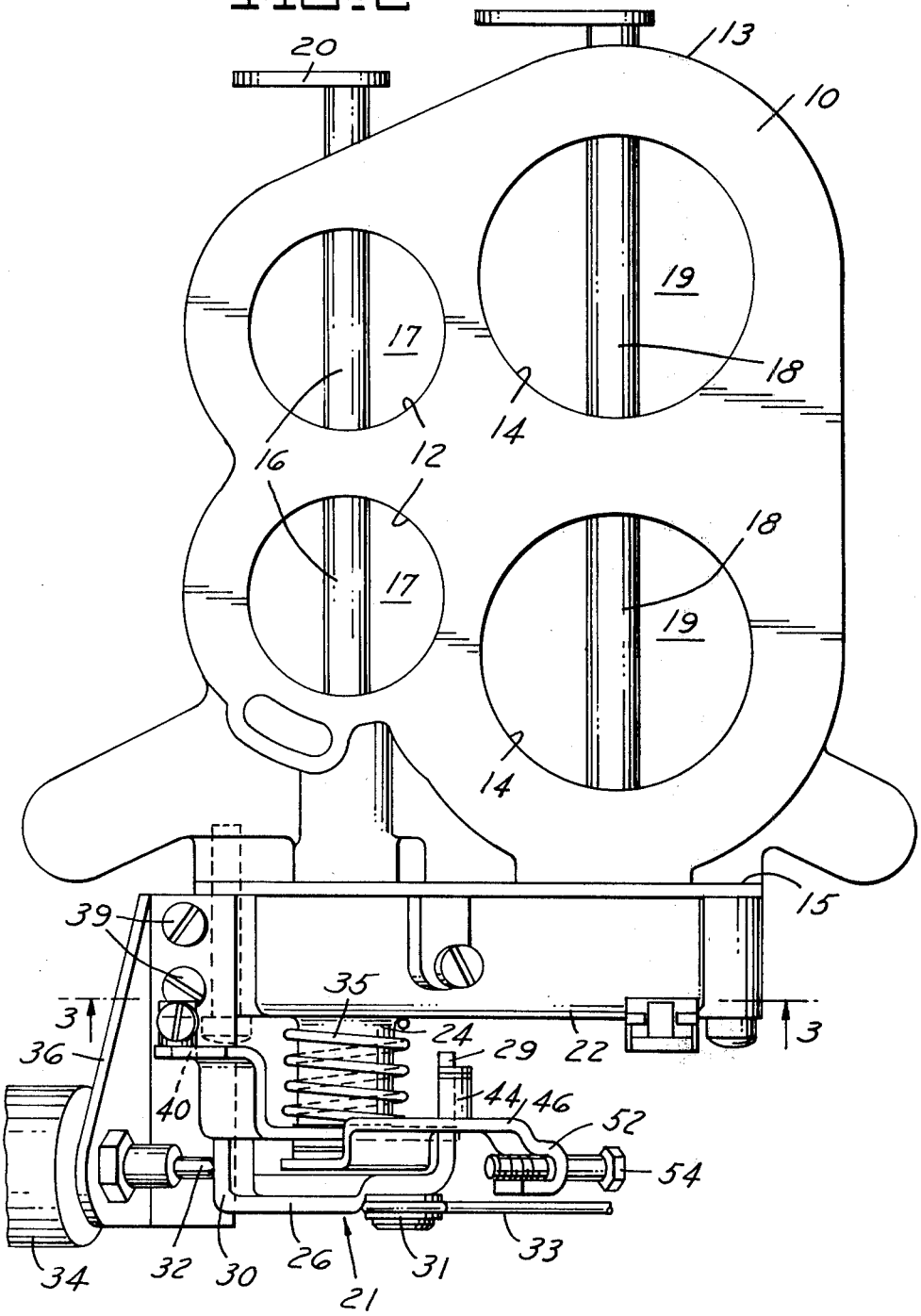
FIG. 2 is a top plan view of the embodiment shown in FIG. 1.

Referring now to FIGS. 1 and 2, a multibarrel carburetor 10 has a system for throttling and opening the passages therethrough.

The carburetor 10 has a pair of primary induction passages 12, a pair of secondary induction passages 14, primary throttle plates 17 pivotably mounted in the primary induction passages 12 and secondary throttle plates 19 pivotably mounted in the secondary induction passages 14. The throttle plates 17 are rigidly connected to shaft 16 which is pivotably mounted in carburetor 10. Throttle plates 19 are rigidly connected to shaft 18 which is pivotably mounted in carburetor 10.

On one side 13 of the carburetor, the primary throttle shaft 16 is connected to a lever 20 which is operably connected to any one of a variety of controls such as governors and other vacuum controls (not shown). The other side 15 of the carburetor 10 has various lever mechanisms, generally indicated at 21 operably connected to the primary throttle plates 17 for controlling the opening and closing of the throttle plates 17.

Figure 3:
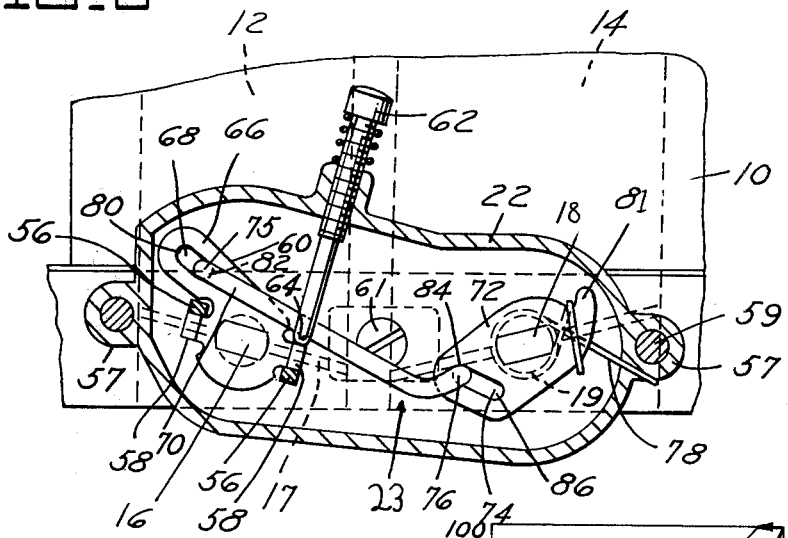
FIG. 3 is a partially segmented side elevational view taken along the line III—III in FIG. 2 disclosing a presently preferred embodiment of the linkage mechanism between the primary and secondary throttles shown with the throttles in their respective closed position.

The lever mechanism 21 includes a housing 22 connected to the side 15 of carburetor 10 which houses a linkage mechanism generally indicated at 23 as shown in FIG. 3 which operably connects the secondary throttle plate 19 to the primary throttle plate 17.

Extending from housing 22 is shaft 24 which is coaxially mounted with respect to the axis of the throttle 17. Shaft 24 connects the primary throttle 16 to the lever mechanism 21. The opening and closing mechanism 25 includes a foot throttle lever 26 rigidly connected to the end of shaft 24. Foot throttle lever 26 has an aperture 28 for receiving a cable (not shown) leading to a foot pedal in a motor vehicle. Adjacent the aperture 28 is a tab 30 positioned to abut protrusion 32 extending from load control solenoid 34 mounted on bracket 36, which in turn is mounted by screws 39 onto carburetor 10.

Lever 26 has a bushing 31 located at an opposing side of the axis of rotation of the lever from aperture 28. Bushing 31 is connected to a spring 33 which biases the foot throttle lever 26 to the closed position. In addition, spring 35 is wrapped about shaft 24 anchored to housing 22, and connected to lever 26 to close lever 26 in the counterclockwise direction as viewed, in FIG. 1. In addition, lever arm 26 has an extension 29 extending to the right as shown in FIG. 1.

Rotatably mounted about shaft 24 is a hand-operated throttle lever 38 with aperture 40 therethrough connected to a hand throttle cable 42. Hand throttle lever 38 has an extension 44 which engages extension 29 of lever 26.

Also rotatably mounted about shaft 34 is transmission kickdown lever 46 with aperture 48 therethrough which is connectable to a rod which connects directly to the transmission. Aperture 50 extending therethrough is connected to a spring (not shown) which biases the arm 48 in the counterclockwise direction shown in FIG. 1. Lever 46 has a flange 52 which has a threaded aperture receiving a bolt 54 therethrough. The end of the bolt 54 is adapted to abut lever 26 to rotate in a clockwise direction upon full throttle opening of lever 26 which would cause an automatic transmission to drop a gear.

DETAILED DESCRIPTION OF THE LINKAGE MECHANISM BETWEEN THE PRIMARY AND SECONDARY THROTTLE PLATES

Housing 22 has a cover 55 bolted onto ears 57 by screws 59. The base housing 22 as shown in FIG. 3 is bolted onto the carburetor 10 by means of screws 61.

The shaft 24 extends within housing 22 and terminates at two lugs 56 as shown in crosssection in FIG. 3. Lugs 56 contact axially extending lugs 58 integral with a primary throttle lever 60 which is rigidly attached to the pivotable throttle shaft 16. Extending through housing 22 is an idle screw 62 which has its end 64 abut one of lugs 58 which defines the closing limit of rotation of the lever 60.

The linkage mechanism 23 includes the throttle lever 60 having an extension portion 66 with a slot 68 extending therethrough. Slot 68 receives one end 75 of rod 70 which forms a linkage to a secondary throttle lever 72 which has a slot 74 therein which receives the other end 76 of rod 70. The secondary throttle lever 72 is rigidly attached to a pivotable secondary throttle shaft 18.

A spring 78 is mounted about shaft 18 and anchored to the carburetor 10. The spring 78 engages tab 81 of secondary throttle lever 72 to bias the throttle lever in the clockwise position as shown in FIG. 3.

The slots 68 and 74 have their respective longitudinal axes form an extremely acute angle. The distance between the slot 74 and the longitudinal axis of slot 68 being relatively small compared to the distance between the shafts 16 and 18. In addition, the longitudinal axis of rod 70 forms acute angles with both the longitudinal axes of slots 74 and 68.

Figure 5:
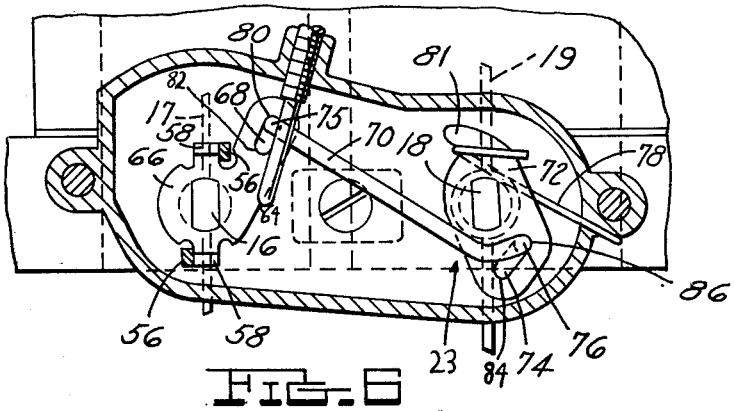
FIG. 5 is a view similar to FIG. 3 showing primary and secondary valves in a fully opened position.

When the throttle plates 17 and 19 are in the open position as shown in FIG. 5, the longitudinal axis of rod 70 is substantially transverse with the longitudinal axis of slots 68 and 74. In addition, the distance between slot 74 and longitudinal axis of slot 68 is much greater than when the throttle plates 17 and 19 are closed. The distance in the open position is approximately equal to the length of rod 70.

Slot 68 has a radially outer end 80 and a radially inner end 82 circumferentially spaced from end 80 with respect to the axis of rotation of shaft 18. Likewise, slot 74 has a radially outer end 84 and radially inner end 86 which is circumferentially spaced from end 84 with respect to the axis of rotation of shaft 18. In addition, ends 84 and 82 oppose each other when the throttle plates are in the closed position as shown in FIG. 3.

OPERATION

Figure 4:
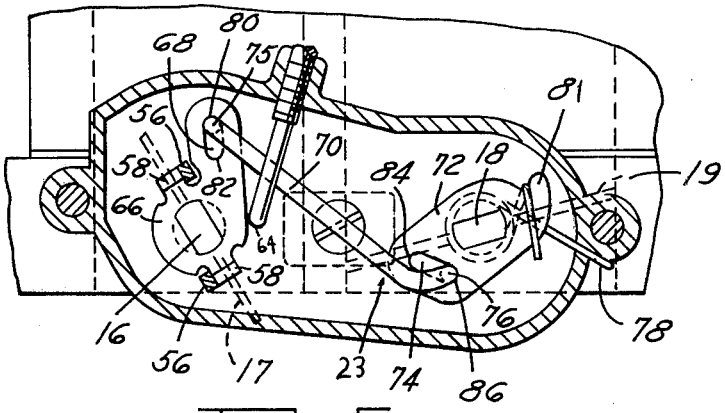
FIG. 4 is a view similar to FIG. 3 showing the primary throttle in a substantially open position with the secondary throttle in a closed position.

The operation of the throttle plates will now be described. As shown in FIG. 3, the throttle plates 17 and 19 are in the closed position. Opening of the primary throttle plates 19 is achieved by movement of either the hand throttle lever 38 or the foot throttle lever 26 in a clockwise rotation as shown in FIG. 1. The rotation of either of these levers rotates lugs 56 as shown in FIG. 3 in a clockwise rotation which would disengage them from their abutting position with lugs 58 of throttle lever 60. Throttle lever 60 is, therefore, free to be opened by mechanisms which are operably connected to lever 20 as shown in FIG. 2, to open throttle lever 60 as desired until lugs 58 engage newly positioned lugs 56 as shown in either FIGS. 4 or 5. During the opening motion of the throttle from a closed position as illustrated in FIG. 3 to a partially open position as illustrated in FIG. 4, the rod 70 has its ends 75 slide from end 82 to end 80 of slot 68 and end 76 slide from end 84 to end 86 of second slot 74. Since the rod 70 provides for lost motion, the throttle lever 72 undergoes no motion during this portion of motion of the primary throttle lever 66. As shown in FIG. 4, the throttle can move approximately 60% to its open position without affecting the position of secondary throttle lever.

Any further clockwise rotation of lugs 56 to a fully open position as illustrated in FIG. 5 will further allow the primary throttle shaft 16 to pivot and in turn pivot throttle plate 17 in a clockwise rotation to a fully open position. During this last 40% of opening motion of the primary throttle plate 17, rod 70 abuts slot end 80. Rod 70 pushes against end 86 of slot 74 to pivot throttle shaft 18 which in turn opens throttle plate 19 from the closed position as shown in FIG. 4 to a fully open position as shown in FIG. 5.

Upon closing of lever arm 26, as viewed in FIG. 1 in a counterclockwise direction, lugs 56 abut lugs 58 and bias throttle lever 60 towards a closed position. Normally, as the throttle lever 60 closes, the secondary throttle lever 72 is biased toward a closed position by spring 78. The secondary throttle lever closes in reverse fashion from the above-described opening thereof. In other words, the throttle lever 72 totally closes during the first 40% of closure to a partially open position of the primary throttle lever 60 which the next 60% of closure of the primary throttle lever 60 having no effect on the secondary throttle lever 72.

Figure 6:
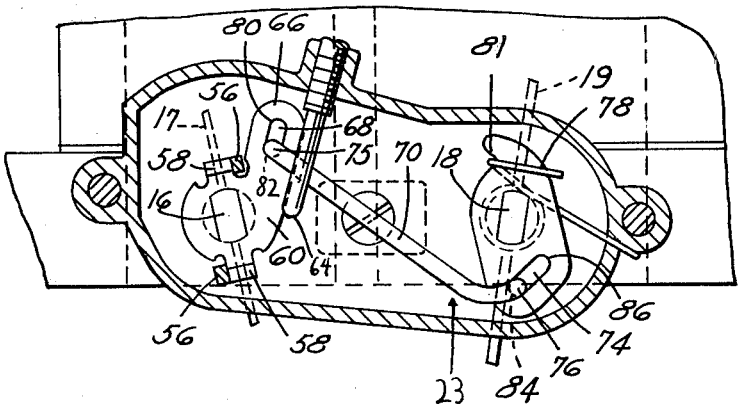
FIG. 6 is a view similar to FIG. 3 showing the primary and secondary valves in a substantially open position moving toward their closed positions.

However, if the spring 78 refrains from closing the secondary throttle lever 72, the end 75 of rod 70 slides from end 80 to end 82 of slot 68 and end 76 of rod 70 slides from end 86 to end 84 of slot 74 during the first 10% of closure to a substantially open position of the primary throttle lever 60. Further closure of the throttle lever from the 90% substantially open position to the totally closed position causes end 82 of slot 68 to abut against end 75 of rod 70 and pull rod 70. Rod 70 in turn has its end 75 abut end 84 of slot 74 and pull lever 72 to pivot shaft 18 as shown in FIG. 6 and totally close the secondary throttle plate 19 in a gradual and steady fashion as shown in FIG. 3.

Figure 7:
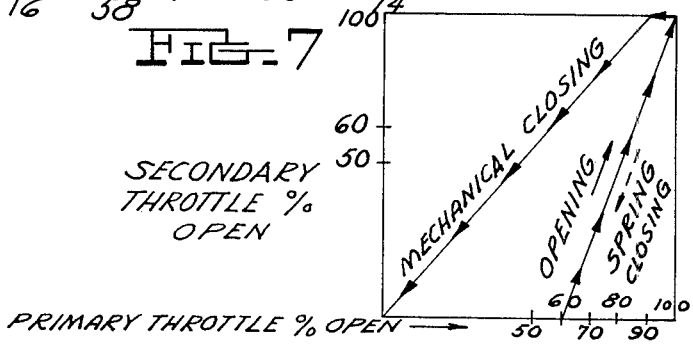
FIG. 7 is a chart plotting the positions of the primary and secondary throttles during the opening and closing of said valves.

FIG. 7 schematically graphs the position of the primary throttle versus the position of the secondary throttle during the opening mode and during the closing mode of the primary throttle.

If the primary throttle is closed from an intermediate position, for example from an 80% open position, the rod 70 has no effect upon the secondary throttle plate 18 until the primary throttle closes slightly more than 10% and the appropriate ratio of the primary throttle being open versus the secondary throttle being open is reached as indicated in the chart in FIG. 7.

If the primary throttle is moved again to an open position from an intermediate position, the lost motion of the rod causes the rod to have no effect upon the secondary throttle until the appropriate ratio of the primary throttle versus the secondary throttle is obtained for the opening mode. When the appropriate ratio is reached, rod 70 pushes open the secondary throttle. The delay in the rod acting upon the secondary throttle allows time for the spring 78 to act in a normal fashion upon secondary throttle 18.

In this fashion, if the spring 78 refrains from closing secondary throttle plate 19 in the normal fashion, the rod 70 insures a mechanical linkage which will substantially close the secondary throttle plate 19 as the primary throttle plate 17 is being substantially closed. In this fashion, the secondary throttle plate 19 is closed in a normal fashion by the spring 78 and, in addition, the carburetor 10 has a backup system which closes the secondary throttle plate in a steady gradual fashion if the spring 78 refrains from closing said secondary throttle plate 19.

Variations and modifications of the present invention are possible without departing from its scope and spirit as defined by the appended claims.

I claim:

1. A throttle assembly in a multi-state carburetor comprising:

primary and secondary induction passages in said carburetor;

a first throttle valve pivotably mounted in the primary induction passage for movement between an open and closed position;

a second throttle valve pivotably mounted in the secondary induction passage for movement between an open and closed position;

means for opening and closing said first throttle valve;

means mechanically linking said first throttle valve to said second throttle valve for opening said second throttle valve when said first throttle valve is moved to a fully open position beyond a partially open position;

principal closing means connected to said second throttle valve for closing said second throttle valve when said first throttle valve partially closes from said fully open position;

said linking means connected to said first and second throttle valve being constructed to gradually close said second throttle valve to a partially closed position when said first throttle valve is moved from a fully open position toward an approximately half-closed position only if said principal closing means refrains from closing said second throttle valve and further movement of said first throttle valve toward a closed position further gradually closes said second throttle valve.

2. A throttle assembly in a multi-stage carburetor comprising;

primary and secondary induction passages in said carburetor;

a first throttle valve pivotably mounted in the primary induction passage for movement between an open and closed position;

a second throttle valve pivotably mounted in the secondary induction passage for movement between an open and closed position;

means for opening and closing said first throttle valve;

means mechanically linking said first throttle valve to said second throttle valve for opening said second throttle valve when said first throttle valve is moved to a fully open position beyond a partially open position;

principal closing means connected to said second throttle valve for closing said second throttle valve when said first throttle valve partially closes from said fully open position;

said linking means connected to said first and second throttle valve being constructed to gradually close said second throttle valve when said first throttle valve is moved toward said closed position only if said principal closing means refrains from closing said second throttle valve;

said linking means comprises:

a rod having one end operably connected within a first slot extending through a lever rigidly connected to said first throttle valve;

said rod having its other end operably connected within a second slot extending through a second lever rigidly connected to said second throttle valve such that said rod is slidable within each slot;

said respective ends of said rod being at one end of said second slot and one end of said first slot when said throttle valves are moved to said closed positions;

said respective ends of said rod constructed to slide to a second end of said first slot and a second end of said second slot while said first throttle valve moves to said partially open position with said second throttle valve remaining in a closed position and gradually opening when said first throttle valve is further moved from its partially open position to its fully open position after said rod has both ends against said second ends of both said first and second slots;

said rod ends slidable to said first ends of said first and second slots when said first throttle valve moves slightly toward its closed position from an open position, with said second throttle valve remaining at rest upon the slight closing of said first throttle valve and gradually moving to its closed position when said first throttle valve is further moved to its closed position after said rod has both ends against said first ends of both said first and second slots.

3. A throttle assembly as defined in claim 2 wherein:

said first and second throttle valves each are pivotably mounted about respective first and second substantially parallel axes;

said first and second levers comprise coplaner flanges which are perpendicular to said pivot axes of said throttle valves;

said slots extending through said respective flanges and having their longitudinal axes comprising a radial component with respect to the pivot axis of said respective throttle valves.

4. A throttle assembly as defined in claim 3 wherein said slots have their respective longitudinal axes further comprising a tangential component with respect to the pivot axis of said respective throttle valves;

said flanges are constructed with said respective slots therethrough such that the distance from one slot to the longitudinal axes of said other slot is substantially smaller when said throttle valves are in said respective closed positions than when in said respective open positions;

the longitudinal axis of said rod forming acute angles with said longitudinal axes of said first and second slots when said throttle valves are in said closed positions;

the longitudinal axis of said rod being substantially transverse to the longitudinal axes of said slots when said throttle valves are in said open positions.

5. A throttle assembly as defined in claim 2 or 3 wherein said linking means are constructed for moving said first throttle valve to said partially open position at 60 % of its full open position before said rod beings opening said second throttle valves, and for gradually opening said secondary throttle valve to its open position when said first throttle valve is opened beyond said partially open position to a fully opened position; and for allowing said first throttle valve to move 5% to 25% toward its closed position when in said fully open position such that said rod has both ends sliding from said second ends of said first and second slots to abut said first ends of said slots and said second throttle valve remaining in its open position if said principal closing means refrains to move said second throttle and gradually closing upon further closure of said first throttle valve.

6. A throttle assembly as defined in claim 5 wherein said principal closing means comprises a spring anchored to said carburetor biasing said second throttle valve to its closed position; and said first throttle valve is constructed to move approximately 10% toward its closed position from a substantially open position before said rod commences to gradually close said second throttle valve with further closing of said first throttle valve.

7. A throttle assembly as defined in claim 6 wherein said opening and closing means for said first throttle valve comprises:

an arm member coaxially mounted with said first throttle valve for pivotable movement about said pivot axis of said first throttle valve;

a throtte cable operatively attached to said arm member for pivotable rotating said arm member in one direction;

lug means operatively connecting said arm member with said lever of said first throttle valve;

said throttle cable being manually operable to rotate said arm member, disengaging said lug means from said first lever, and freeing said first lever to move said first throttle valve toward an open position;

spring means mounted to said arm member for biasing said arm member in an opposite direction from said rotating direction caused by said cable;

said lever constructed to engage said lug means when biased to said opposite direction to said first throttle lever to move said throttle valve toward its closed position.

8. A throttle assembly as defined in claim 7 wherein said lug means comprise two lugs integral with said arm member axially extending toward said flange of said lever for said first throttle valve;

said flange having two lugs integral therewith axially extending toward said arm member;

said pair of arm member lugs offset from said pair of flange lugs with sides of said arm member lugs abutting sides of said pair of flange lugs and biasing said flange lugs to move said first throttle valve to said closed position;

said arm member pivotable about said pivot axis by manual operation of said throttle cable to pivot said arm member lugs away from said flange lugs to a second position and to free said first throttle valve to allow it to open till said flange lugs abut said newly positioned arm member lugs.

* * * * *